United States Patent [19]

Sakaguchi et al.

[11] Patent Number: 4,774,921

[45] Date of Patent: Oct. 4, 1988

[54] METHOD AND SYSTEM FOR CONTROLLING AN ENGINE

[75] Inventors: Satoshi Sakaguchi, Hirakata; Yoshihiro Nagata, Joyo, both of Japan

[73] Assignee: Kabushiki Kaisha Komatsu Seisakusho, Tokyo, Japan

[21] Appl. No.: 780,773

[22] Filed: Sep. 27, 1985

[30] Foreign Application Priority Data

Dec. 13, 1984 [JP] Japan ..... 59-261828

[51] Int. Cl.[4] ..... F02M 39/00

[52] U.S. Cl. ..... 123/385; 123/365; 414/699

[58] Field of Search ..... 123/385, 386, 387, 365, 123/340, 342; 414/699

[56] References Cited

U.S. PATENT DOCUMENTS

| | | | |
|---|---|---|---|
| 2,986,291 | 5/1961 | Shick | 414/699 |
| 3,095,990 | 7/1963 | Granryd | 414/699 |
| 3,148,790 | 9/1964 | Zikal | 414/699 |
| 3,901,395 | 8/1975 | King | 414/699 |
| 3,916,767 | 11/1975 | Barton | 414/699 |
| 3,981,508 | 9/1976 | Norlin et al. | 123/385 |
| 4,373,850 | 2/1983 | Dorham | 123/386 |
| 4,528,892 | 7/1985 | Okube | 414/699 |
| 4,606,313 | 8/1986 | Izumi | 123/386 |

FOREIGN PATENT DOCUMENTS

| | | | |
|---|---|---|---|
| 1157087 | 11/1963 | Fed. Rep. of Germany | 414/699 |
| 3134068 | 5/1984 | Fed. Rep. of Germany | 123/385 |
| 0133451 | 8/1983 | Japan | 123/385 |
| 58-156138 | 10/1983 | Japan | 123/385 |
| 60-38561 | 2/1985 | Japan . | |

*Primary Examiner*—Carl Stuart Miller

*Attorney, Agent, or Firm*—Armstrong, Nikaido, Marmelstein & Kubovcik

[57] ABSTRACT

An engine of a construction vehicle is controlled by a system which includes an engine control operation transmitting mechanism having a loose spring means and connecting a fuel control lever and a governor control lever; a decelerator cylinder accommodating a piston therein and having a spring for biasing always the piston on the opposite side of a pressure chamber defined thereby and on the side of the spring a piston rod connected through a york having an elongated hole formed therein to said transmitting mechanism; a solenoid valve adapted to supply the fluid under pressure delivered by a hydraulic pump driven by the engine for exclusive use in control of the system into the pressure chamber of the decelerator cylinder, and cut off the fluid supply; and an electric circuit for controlling the solenoid valve. The above-mentioned decelerator cylinder is so arranged, when the piston is not subjected to the fluid pressure force, as to transmit directly the operation of the fuel control lever to the governor control lever, while when the piston is subjected to the fluid pressure force, to set the governor control lever at a decelerating position even when the fuel control lever is held at a full speed running position, thereby reducing the number of revolutions of the engine to those in the idling speed condition.

1 Claim, 7 Drawing Sheets

METHOD AND SYSTEM FOR CONTROLLING AN ENGINE

BACKGROUND OF THE INVENTION

1. Field of the Invention

This invention relates to a method for controlling the rotation of an engine, in particular, an engine of a construction vehicle such as, for example, a power shovel or the like, and a system for carrying out the method, and more particularly to an auto-decelerator system.

Construction vehicles such as power shovels etc. are operated for excavation and earth moving etc. under the condition that engines are running at their full speeds. Between the excavating and earth moving operations, there is a time of suspension or out of operation such as waiting time for dump trucks. During such a time of suspension of operation, it is desirable to run the engine idle in order to prevent the occurrence of noise and practice economy in fuel consumption. It is, however, trouble-some for operators to shift the fuel control lever to its idling position each time of suspension of operation. For this purpose, in the engine fuel control system there is provided an auto-decelerator device arranged, when the operation is suspended and all actuators are rendered inoperative, to detect this condition to allow the engine's fuel control system to be operated under idling condition irrespective of the fuel control lever located at its full speed running position.

2. Description of the Prior Art

The construction vehicles such as power shovels etc. have been disadvantageous in that when the number of revolutions of the engine is set by means of a fuel control lever, the engine continues to run at the same number of revolution even when excavating and earth moving operation are suspended thereby generating noise and increasing fuel consumption.

To eliminate the above-mentioned disadvantage, the applicant of the present invention developed an engine control system for a construction vehicle such as a shovel loader etc. as disclosed in Japanese Utility Model Provisional Publication No. 58-156138 arranged such that pressurized fluid is supplied into a running control circuit and an implement control circuit by at least two hydraulic pumps driven by the engine, and the number of revolutions of the engine is set by means ofaa governor control lever adapted to be operated by a fuel control lever, characterized in that said governor control lever is provided with a hydraulic cylinder for driving adapted to hold the governor control lever at its idling position (that is; low speed running position) when the hydraulic pump is under no load condition and also to move the governor control lever to its full speed running position as the load on the hydraulic pump increases.

This engine control system, however, utilizes the fluid pressure delivered by the hydraulic pump to urge the governor control lever in the direction of full speed rotation, and so it is subjected to the influence by changes in manipulated variable produced by the fluid pressure force thus causing an undesirable low speed (idling) condition of the engine. For example, when an implement is lowered, the lowering of the implement by its dead weight gives an adverse affect so that a sufficient rise in fluid pressure cannot be obtained. This is true in the case of turning of the turning unit by its inertia. Consequently the fluid pressure required to urge the governor control lever in the direction of full speed rotation will drop thus causing a movement of the lever towards idling position by a resilient force of a spring thereby reducing the number of revolutions of the engine. Furthermore, since the fluid pressure required to urge the governor control lever in the direction of full speed rotation becomes unavailable when all the operating levers are shifted to their neutral positions, the number of revolutions of the engine will drop immediately thus causing a time lag in operation when excavation and earth moving operations are made successively, a deterioration in operating performance and repeated increase in number of revolutions of the engine thereby generating noise.

The present invention has been developed in view of the above-mentioned circumstances, and has for its aspect to provide a method and a system for controlling an engine of a construction vehicle such as a shovel loader etc., characterized in that it comprises a hydraulic pump for exclusive use in controls of the governor without having to use fluid under pressure delivered from hydraulic pumps for use in implements, the arrangement being made such that changes in fluid pressure force due to operation of the implement do not give adverse affect to the control of the governor, the fluid under pressure delivered from the hydraulic pump for controlling the governor is controlled by means of a solenoid control valve to thereby extend and contract the piston rod of a decelerator cylinder, said solenoid control valve being adapted to be changed over in electrical response to the positions of implement operating levers, and said governor can be controlled automatically between full speed rotating condition and idle running condition.

Another aspect of the present invention is to provide a method and a system for controlling an engine of a construction vehicle such as a shovel loader etc., characterized in that it comprises a single timer so that a governor control lever is held at its full speed running position for a few seconds, for example, about four seconds after all operating levers have been returned to their neutral positions, respectively, and then automatically moved to its idling position.

A further aspect of the present invention is to provide a method and a system for controlling an engine of a construction vehicle such as a shovel loader etc., characterized in that it comprises two timers so that a governor control lever is moved towards its idling position immediately after all operating levers have been returned to their neutral positions thus causing a temporary small extent reduction in the number of revolutions of the engine, and then moved again to its idling position to enable a further large extent reduction in the number of revolutions to be obtained.

To achieve the above-mentioned first and second aspects, according to the present invention, there is provided a method of controlling an engine provided with an auto-decelerator system in a construction vehicle such as a shovel loader etc., characterized in that the auto-decelerator system is actuated a few seconds after all operating levers have been returned to their neutral positions, respectively, thereby allowing the number of revolutions of the engine to be reduced from those in the full speed condition to those in the idling speed condition.

Further, to achieve the above-mentioned third aspect, according to the present invention, there is provided a method for controlling an engine provided with an auto-decelerator system in a construction vehicle such as a shovel loader etc., characterized in that the auto-decelerator system is temporarily actuated immediately after all operating levers have been returned to their neutral positions, respectively, thereby causing a small extent reduction in the number of revolutions of the engine, and after allowing the engine to run under such a condition for a predetermined period of time, the auto-decelerator system is actuated again to reduce the number of revolutions of the engine to those in the idling speed condition.

Still further, to achieve the above-mentioned first and second aspects, according to the present invention, there is provided an auto-decelerator system comprising a mechanism for mechanically transmitting the manipulated variable produced by the fuel control lever through the intermediary of a loose spring to the governor of the engine; a hydraulic actuator connected between the loose spring of the manipulated variable transmitting mechanism and the governor, the hydraulic aotuator being adapted, when actuated, to return the governor to its idling position; means for detecting the inoperative condition of all operating levers in the construction vehicle, and a timer circuit device for actuating said hydraulic actuator when the inoperative condition of said operating levers has been detected continuously for more than a predetermined period of time.

Further, to achieve the above-mentioned third aspect, according to the present invention, there is provided an auto-decelerator system comprising a mechanism for mechanically transmitting the manipulated variable of the fuel control lever through the intermediary of a loose spring to the governor of the engine; a hydraulic actuator connected between the loose spring of the manipulated variable transmitting mechanism and the governor, the hydraulic actuator being adapted, when actuated, to return the governor to its idling position; means for detecting the inoperative condition of all operating levers of the construction vehicle, and a timer circuit device including a first timer adapted to detect immediately the inoperative condition of the operating levers to actuate temporarily the hydraulic actuator and a second timer adapted to activate the hydraulic actuator again a predetermined time after the first timer is rendered off.

In the above-mentioned auto-decelerator system, the operating levers comprise implement operating levers and running operation control levers, the implement operating levers serving to actuate proportional pilot control valves adapted to control the fluid pressure supplied by variable displacement pumps into implement operating hydraulic actuators, and detection of the inoperative condition of the implement operating levers is made by means of a pressure switch adapted to detect the pressure of the fluid discharged through the proportional pilot control valves.

Further, in the above-mentioned auto-decelerator system, te hydraulic actuators each comprise a decelerator cylinder fixedly secured to the side of the bottom thereof which has a pressure chamber formed therein and including, on the head side thereof, a piston rod connected through a york having an elongated hole formed therein to the manipulated variable transmitting mechanism, and a solenoid valve adapted to receive a signal from the controller device thereby supplying the fluid under pressure delivered by a hydraulic pump driven by the engine and which is independent from the implement operating hydraulic pump into the pressure chamber of the decelerator cylinder, the arrangement being made such that, when the hydraulic actuator is under inoperative condition, the movement of said transmitting mechanism caused by the manipulated variable of the fuel control lever is absorbed by the elongated hole of the york so that no influence is given to the operation of the fuel control lever, whilst when the hydraulic actuator is under operating condition, the movement of the transmitting mechanism is restricted by one end of the elongated hole of the yoke.

The above and many other advantages, features and additional objects of the present invention will become apparent to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
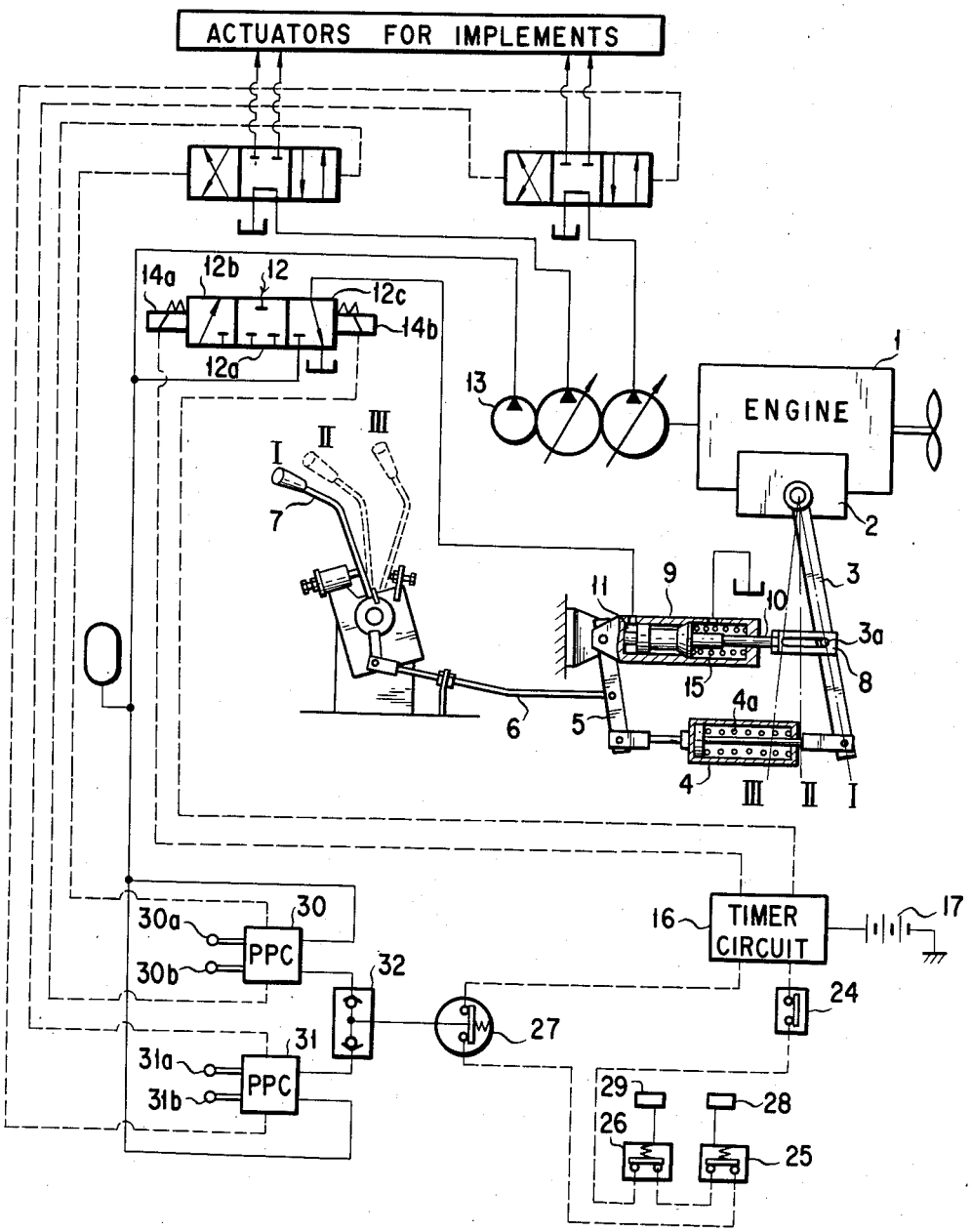
FIG. 1 is a schematic configurative view showing a first embodiment of an engine control system incorporating an auto-decelerator system according to the present invention.

One embodiment of the engine control system according to the present invention will now be described below with reference to the accompanying drawings (FIGS. 1 to 6).

In the drawings, reference numeral 1 denotes an engine, 2 a governor, and 3 a control lever for controlling the governor 2. The arrangement is made such that when the control lever 3 occupies a stop position I, an idling position II and a full speed position III, respectively, the engine 1 is stopped, run idly and run at full speed. The control lever 3 is connected through a loose spring means 4, a link 5 and a rod 6 to a manual fuel control lever 7. A piston rod 10 of a decelerator cylinder 9 is connected through a york 8 having an elongated hole formed therein to the intermediate portion of the control lever 3. When the fluid under pressure is supplied into a pressure chamber 11 formed in the bottom side of the decelerator cylinder 9, the piston rod 10 is moved to the right in the drawing against the biasing force of a spring 15 to move the above-mentioned control lever 3 from the full speed position to the idling position or decelerating position.

Figure 2:
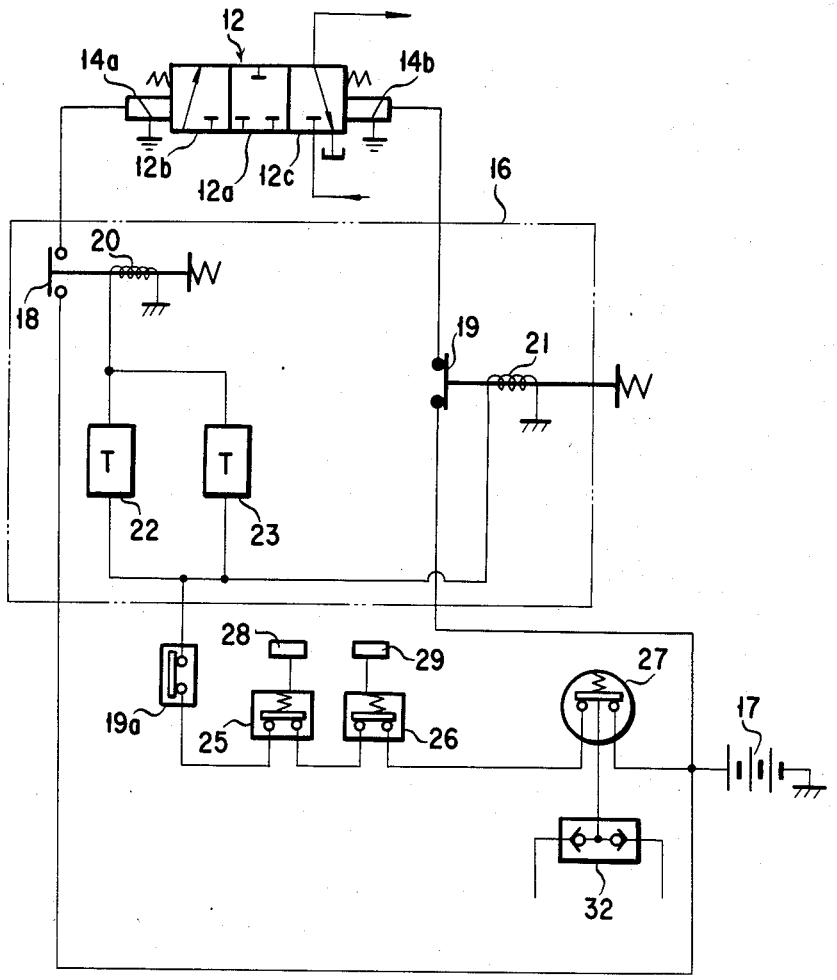
FIG. 2 is a circuit diagram illustrating one example of a timer circuit used in the embodiment shown in FIG. 1.

The pressure chamber 11 defined in the bottom of the above-mentioned decelerator cylinder 9 is connected through a solenoid valve 12 with a hydraulic pump 13 used exclusively for controlling the decelerator. The solenoid valve 12 has an "off" (neutral) position 12*a*, "decelerating" position 12*b* and "drain" position 12*c*. The solenoid valve 12 is normally biased to "off" position 12*a*, and is changed over to "decelerating" position 12*b* or "draining" position 12*c* by selectively energizing a first solenoid 14*a* or a second solenoid 14*b*. Both the above-mentioned solenoids 14*a* and 14*b* are connected through a timer circuit 16 with a power supply 17. This timer circuit 16 is arranged as shown in FIG. 2, and comprises a normally open switch 18 interconnected between the first solenoid 14*a* and the power supply 17, a normally closed switch 19 interconnected between the second solenoid 14*b* and the power supply 17, an induction coil 20 for the normally open switch 18, an induction coil 21 for the normally closed switch 19, and a first timer 22 and a second timer 23 which are interconnected between the induction coil 20 of the normally open switch 18 and the input side thereof. The input side of the timer circuit 16 is connected through an auto-decelerating switch 24, the left and right running limit switches 25 and 26, and a pressure switch 27 with the power supply 17.

The above-mentioned running limit switches 25 and 26 are adapted to be rendered on and off by means of the left and right running operating levers 28 and 29, respectively. In brief, the limit switches 25 and 26 are turned off when the levers 28 and 29 are manipulated.

Reference numerals 30 and 31 denote proportional pilot control valves (PPC valves). Both the proportional pilot control valves 30, 31 are connected with the above-mentioned hydraulic pump 13 for controlling the decelerator. When implenent operating levers 30*a*, 30*b* and 31*a*, 31*b* of the PPC valves 30 and 31 are operated, the control fluid pressure supplied into actuators for implements, for example, directional control valves (not shown) installed in a hydraulic circuit for the boom cylinder, the arm cylinder, the bucket cylinder and the turning motor, etc., is controlled to thereby control or change over the directional control valves. The circuits of the proportional pilot control valves 30 and 31 are connected through a shuttle valve 32 with the pressure switch 27. When the proportional pilot control valves 30 and 31 are actuated by operating the levers 30*a*, 30*b*, 31*a* and 31*b*, the pressure switch 27 is rendered off.

Out of the above-mentioned first and second timers 22 and 23, the first timer 22 is rendered on immediately after the input side of the timer circuit 19 has received an input, thereby holding the "ON" condition for an extremely short time, for example, about one second, and then rendered off. Whilst, the second timer 23 is adapted to be rendered on a predetermined time, for example, about four seconds after the timer circuit 19 has received an input. This second timer 23 is rendered off when the input to the timer circuit 19 is cut off by manipulating the operating lever for running or the operating lever for implement.

Since the manipulated variable produced by the fuel control lever 7 is transmitted to the governor 2 of the engine 1 through a rod-link assembly comprised of the rods 6 and 5, the cylinder 4 including the loose spring 4*a*, and the rod 3, the number of revolutions of the engine 1 is controlled in accordance with the amount of fuel injected in response to the position of the governor 2. The stop position I of the fuel control lever 7 corresponds to the position where no fuel is supplied by the governor 2. Further, the positions II and III of the fuel control lever 7 corresponds to the engine idling position and the engine full speed running position, respectively.

The operation of the above-mentioned arrangement will be described below.

Figure 3:
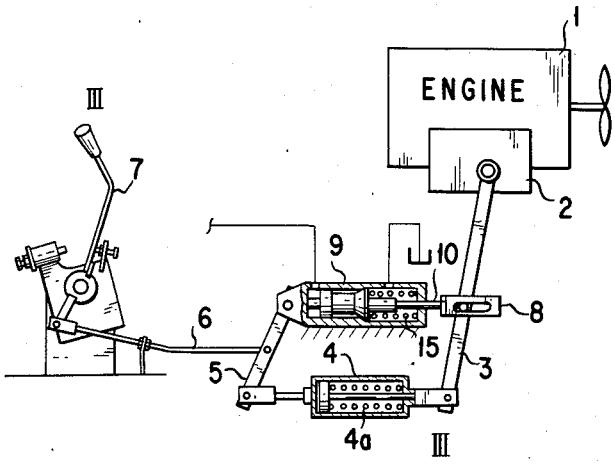
FIGS. 3 and 4 show the conditions of the auto-decelerator system of the present invention before and after actuation.

The engine 1 of construction vehicle is normally run at its full speed so as to develop its maximum output. In brief, the fuel control lever 7 is normally set at a full speed running position as shown in FIG. 3. At that time, the movement of the control lever 3 of the governor 2 is not subject to any mechanical interference by the decelerator cylinder 9 because of the presence of the elongated hole 8*a* of the york 8.

Figure 4:
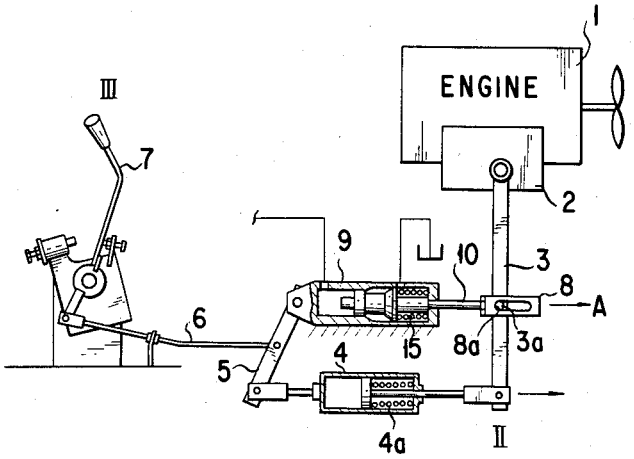

If, with the auto-decelerator switch 24 being turned on, for example, all the operating levers are not manipulated and held at their neutral positions for a predetermined time, the timer circuit 16 will detect this condition and turn the solenoid valve 12 on thereby supplying fluid under pressure through the solenoid valve 12 into the decelerator cylinder 9. In consequence, the piston rod 10 within the decelerator cylinder 9 is extended as shown in FIG. 4 to engage one end 8*a* of the elongated hole of the york 8 with a pin 3*a* of the rod 3 and push the rod 3 back in the direction shown by arrow A.

As a result, the governor 2 is moved to the auto-decelerating position so that the number of revolutions of the engine 1 may be automatically reduced to a rotating speed lower than the full speed. Further, the movement of the rod 3 at that time is absorbed by the cylinder 4 having the loose spring 4*a* so as not to allow actuation of the rods 6 and 5 and the fuel control lever 7.

The operation of the auto-decelerator system of the present invention shown in FIG. 4 will be described below in more detail.

When all the operating levers are located at their neutral positions, the left and right running limit switches 25 and 26 and the pressure switch 27 will be turned on so that the timer circuit 16 will receive an input. Under this condition, the normally closed switch 19 is turned on and the first timer 22 is rendered on immediately for a short period, and as a result, the normally open switch 18 is rendered on for a short time, and then rendered off. When a predetermined time has passed after the timer circuit 16 has received an input, the second timer 23 is actuated thereby turning the normally open circuit 18 on.

Figure 5:
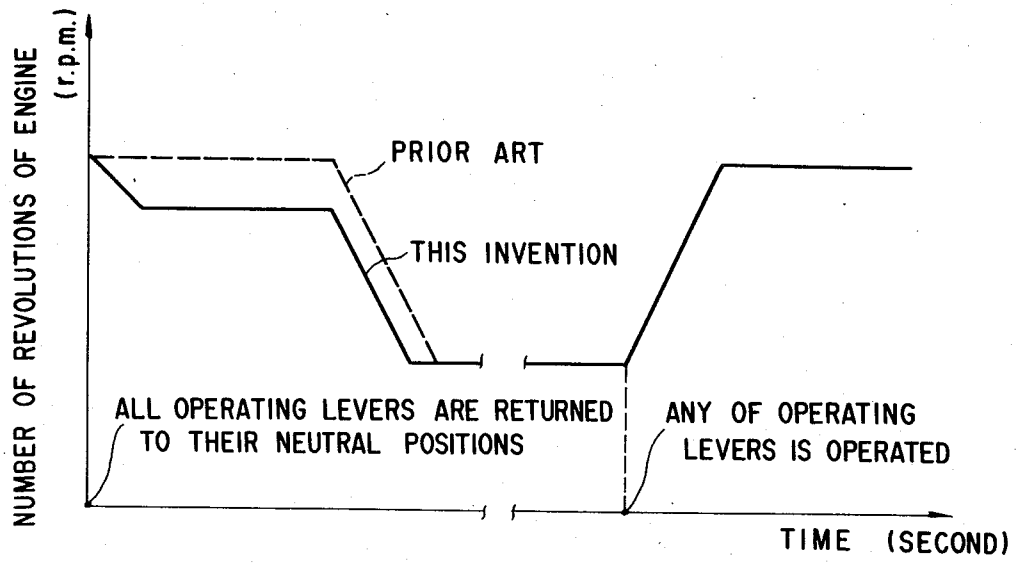
FIG. 5 is a diagram showing changes in the number of revolutions of the engine when the auto-decelerator system of the present invention is actuated.

By the above-mentioned operation, when all the operating levers are located at neutral positions, the solenoid control valve 12 is moved momentarily to "decelerating" position 12*b* and then returned to "off" position 12*a*, and after that moved again to "decelerating" position 12*b*. Therefore, the decelerator cylinder 9 will move, stop and then move. The control lever will follow the operation of the decelerating cylinder 9 so that the number of revolutions of the engine 1 is reduced slightly in the initial phase, and then reduced to a large extent as shown by solid line in FIG. 5; that is, the number of revolutions of the engine is reduced in two stages. The dotted line in FIG. 5 shows changes in the number of revolutions of the engine provided with the conventional auto-decelerator system.

Figure 6:
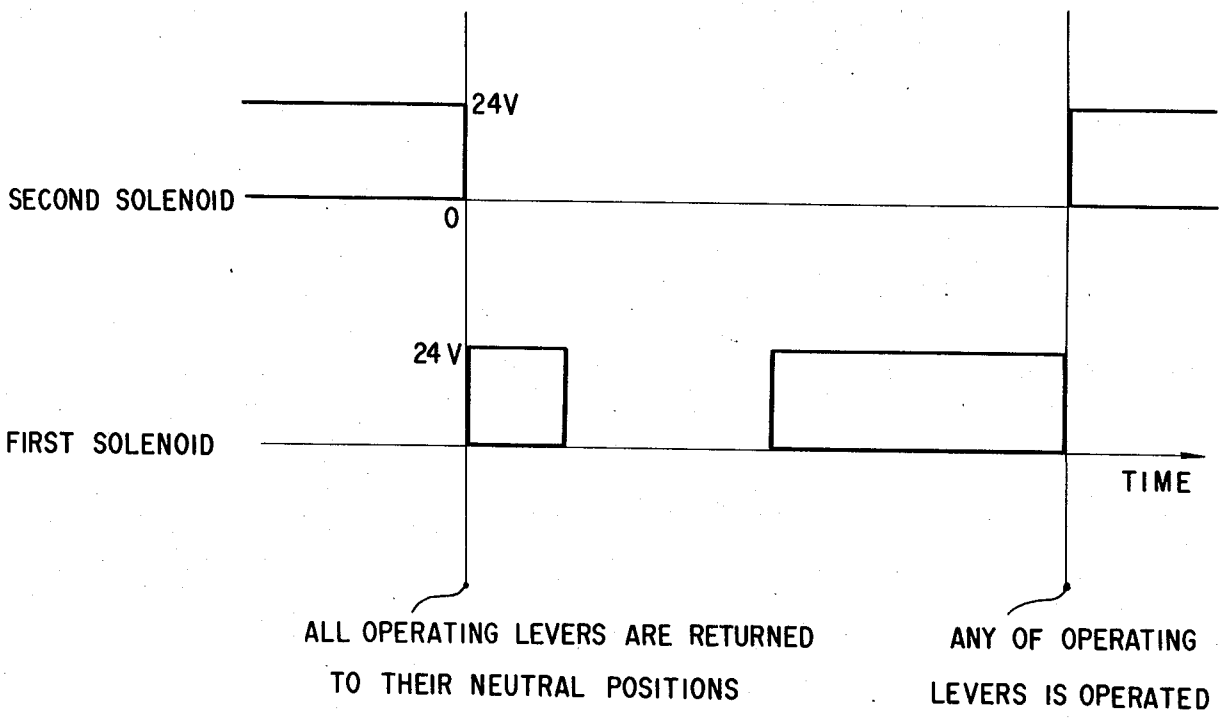
FIG. 6 is a time chart showing operation of a solenoid control valve used in the embodiment shown in FIG. 1.

The operation time chart of the solenoid control valve 12 under the above-mentioned condition is as shown in FIG. 6.

If at least one of the implement operating levers is manipulated under the decelerating condition, input to the timer circuit 16 is rendered off, and as a result, the second timer 23 is turned off, and at the same time, the normally closed switch 19 is turned on. Consequently, the solenoid control valve 12 will occupy its drain position 12*c* to release the decelerating operation so that the engine 1 may be returned to the full speed running condition set by the fuel control lever 7.

If, with all the operating levers located at neutral positions, one of the levers is shifted to neutral position so as to suspend once the excavating or earth moving operation, and then the operation is resumed, the above-mentioned deceleration in the first stage is obtained. However, the reduction in the number of revolutions of the engine at that time is extremely small. Therefore, the change in the noise generated by the engine is comparatively small as compared with that generated when the engine is changed over to the idle running condition so that the operator does not have unpleasantness and the adverse effect to the engine due to a large change in the number of revolutions becomes almost negligible.

In the next place, another embodiment of the system for controlling the number of revolutions of the engine according to the present invention will now be described with reference to FIG. 7.

Figure 7:
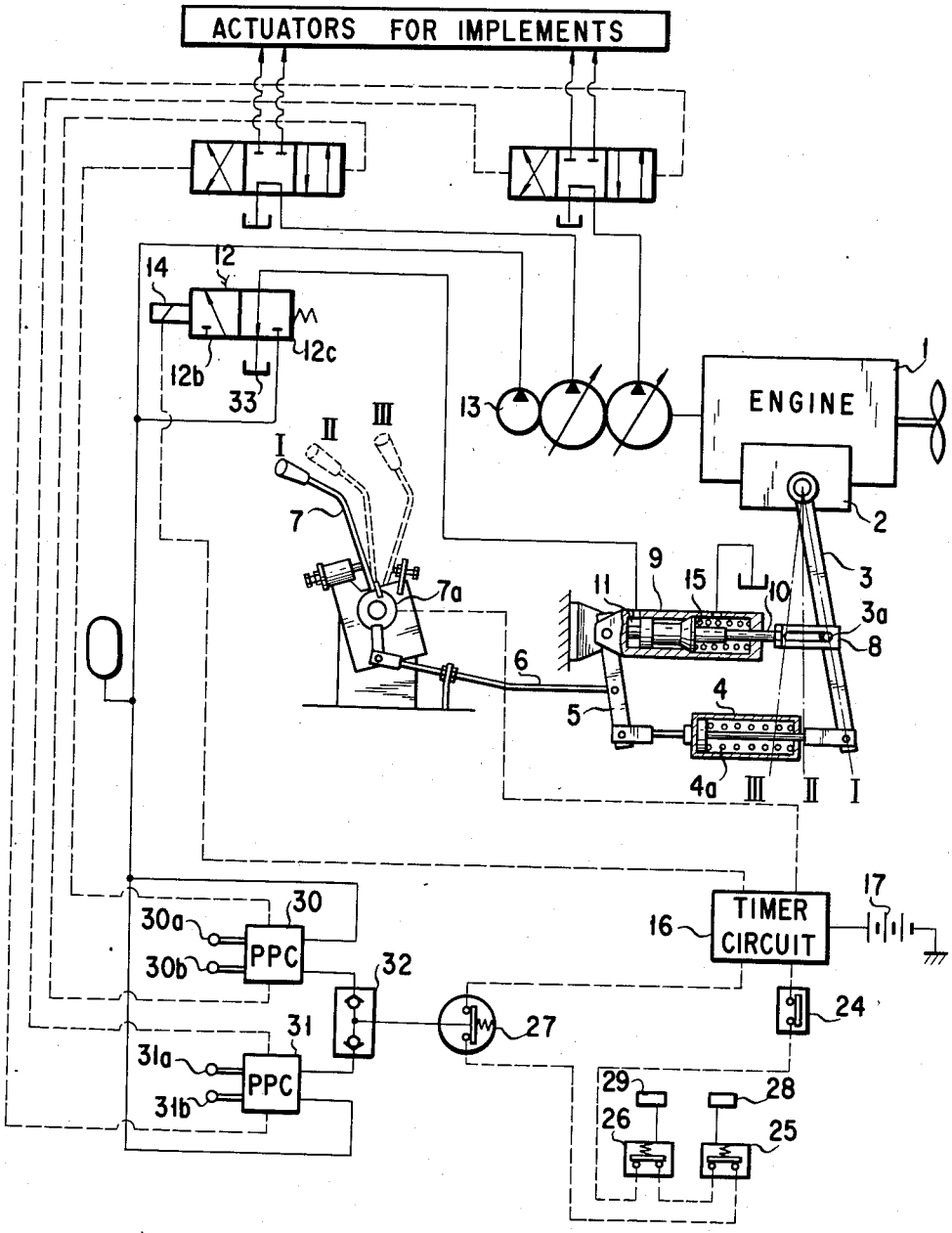
FIG. 7 is a schematic view showing a second embodiment of engine control system incorporating an auto-decelerator system of the present invention.

Component parts shown in FIG. 7 and indicated by the same reference numerals as those used for the component parts in FIG. 1 fulfill the same or similar functions as those elements shown in the first embodiment. Therefore, detailed description of them is omitted herein to avoid duplication of explanation.

A first difference of the embodiment shown in FIG. 7 from that shown in FIG. 1 resides in that the fuel control lever 7 is provided with a potentiometer 7*a* which is adapted to detect the manipulated position of the lever 7 and input a detection signal to the timer circuit 16. In brief, the function of the potentiometer 7*a* is to detect whether or not the manipulated position of the fuel control lever 7 corresponds to a position which meets the number of revolutions of more than that required to actuate the auto-decelerator system, for example, more than 1,400 r.p.m. However, the detection of the number of revolutions of the engine is not always limited to the use of the potentiometer 7*a* fitted to the fuel control lever 7, and instead the engine may be provided with a detector capable of reading out directly the number of revolutions of the engine and transmitting a detection signal to the timer circuit 16.

A second difference lies in that the construction of the solenoid valve 12 is simplified. Stating in brief, in this second embodiment, the solenoid valve 12 has two positions only, i.e., "decelerating" position 12*b* and "draining" position 12*c* and "off" (neutral) position is omitted. Therefore, a solenoid valve is provided only on the side of decelerating position. The solenoid valve 12 is normally urged by the force of a spring to the draining position.

In connection with the second difference, a third difference of the second embodiment from the first embodiment resides in that only one timer is provided in the timer circuit. However, if it is desired, as in the case of the first embodiment, to reduce the number of revolutions of the engine in two stages, it can be achieved by providing two timers in the timer circuit 16 and using solenoid valve 12 having the construction shown in FIG. 1.

Next, the operation of the embodiment shown in FIG. 7 will be described below.

In the case where the fuel control lever 7 is located at a position indicating the number of revolutions of more than that at the time of auto-deceleration (for example, the full speed running position), it is detected whether or not the circuit (detection circuit) including the aforementioned auto-decelerating switch 24, the running limit switches 25 and 26, and the pressure switch 27 connected in series is closed.

In case the above-mentioned detection circuit is closed, the construction vehicle does not effect any operation, and so the timer provided in the timer circuit 16 is actuated. This timer serves to measure the timer for which the above-mentioned detection circuit is closed. If the closed circuit condition continues for a predetermined time, for example, four seconds, the timer will transmit a signal which turns the solenoid valve 12 on.

As aforementioned, when the solenoid valve 12 is turned on, the decelerator cylinder 9 is actuated so that the number of revolutions of the engine 1 will be reduced to the level corresponding to the auto-decelerating position of the governor 2.

Figure 8:
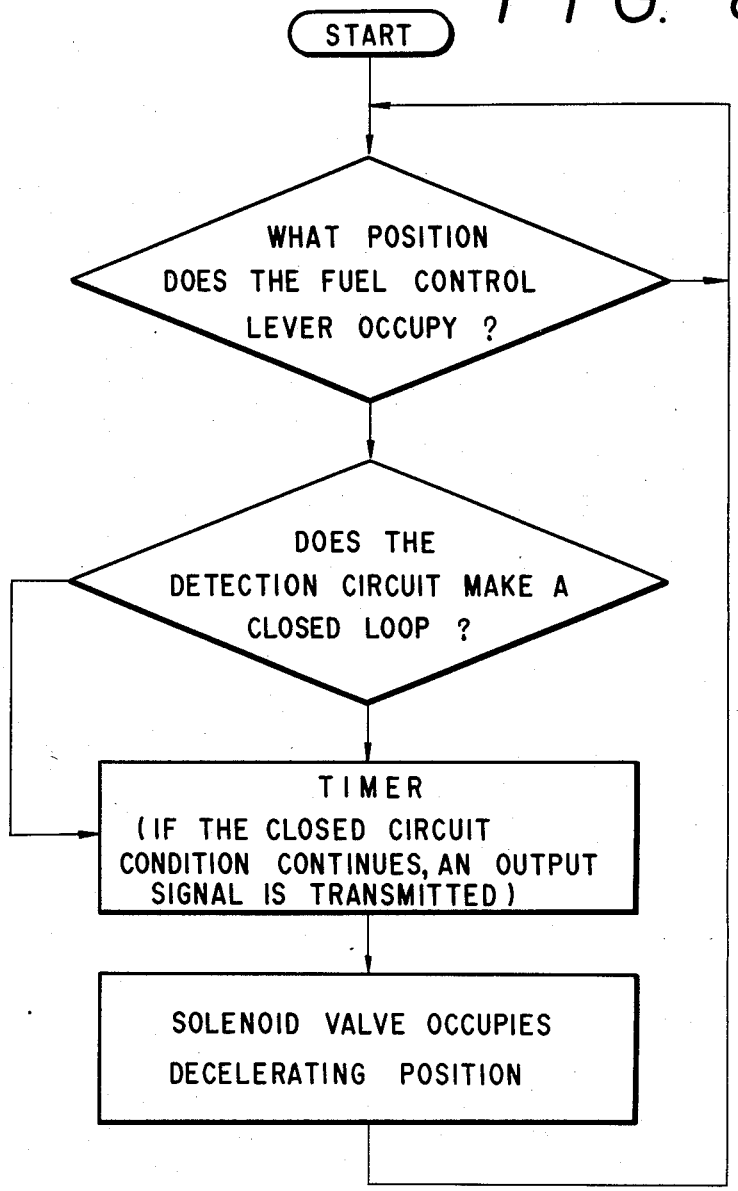
FIG. 8 is a flow chart showing the content processed by a controller system used in the second embodiment shown in FIG. 7.

Further, the timer is reset when the detection circuit is closed. Therefore, if for example the implement operating levers are manipulated when the auto-decelerator system is actuated to reduce the number of revolutions of the engine, the above-mentioned detector circuit is opened so that the solenoid valve 12 may assume draining position 12*c*. In consequence, the spring 15 mounted within the decelerator cylinder 9 will push the piston rod 10 back to thereby allow the fluid under pressure within the cylinder 9 to flow into drain sump 33. At the same, a loose spring 4*a* in the cylinder 4 which has been compressed will extend thereby allowing the rod 3 of the governor 2 to return to the full speed running position as shown in FIG. 3. The above-mentioned operation is shown schematically in the form of a flow chart in FIG. 8.

Further, in this embodiment, while the inoperative condition of the implement operating levers are detected by the pressure switch 27, each of the implement operating levers may be provided with a limit switch to detect the neutral position of each of the levers so that inoperative condition may occur when all the limit switches detect the neutral positions of respective levers at the same time.

According to the present invention, when all the operating levers assume their neutral positions, the number of revolutions of the engine will be reduced immediately from those in the full speed running condition, and therefore further reduction in fuel consumption and noise level can be achieved as compared with the conventional system. Further, as soon as all the operating levers occupy their neutral positions, a first stage decelerating condition is reached, and in a predetermined time a second stage decelerated condition is reached. Therefore, the first stage deceleration serves to call the operator's attention to it, and so it is possible to let the operator to find the decelerating condition at the initial stage of manipulation of the levers.

Further, the present invention has the two systems, i.e., the system of controlling the governor by means of the fuel control lever and the system of automatically controlling the governor by means of the controller, and in particular, the former control of the governor can be made manually and mechanically. Therefore, even when a failure occurs in the electrical system, the number of revolutions of the engine can be controlled, and also, the arrangement is made such that no mutual interference occurs between the two control systems.

It is to be understood that the foregoing description is merely illustrative of preferred embodiments of the present invention and that the invention is not to be limited thereto, but is to be determined by the scope of the appended claims.

We claim:

1. A method for controlling an engine provided with an auto-decelerator system in a construction vehicle said construction vehicle having plural operating levers, characterized in that said auto-decelerator system is automatically temporarily actuated immediately after all of said plural operating levers have been returned to their neutral positions, respectively, thereby causing a small extent reduction in the number of revolutions of the engine, and after allowing the engine to run under such a condition for a predetermined period, said auto-decelerator system is automatically actuated again to reduce the number of revolutions of the engine to those in the idling speed condition.

* * * * *